US007669606B2

(12) United States Patent
Byun

(10) Patent No.: US 7,669,606 B2
(45) Date of Patent: Mar. 2, 2010

(54) MAKE UP CASE EASY TO DISCHARGE POWDER

(76) Inventor: Young-Kwang Byun, 928-1005, Mok-dong APT, 312, Shinjeong-dong, Yangcheon-ku, Seoul 158-769 (KR)

( * ) Notice: Subject to any disclaimer, the term of this patent is extended or adjusted under 35 U.S.C. 154(b) by 273 days.

(21) Appl. No.: 11/600,715

(22) Filed: Nov. 17, 2006

(65) Prior Publication Data

US 2007/0209675 A1 Sep. 13, 2007

(30) Foreign Application Priority Data

Mar. 7, 2006 (KR) ..... 10-2006-0021157
Sep. 28, 2006 (KR) ..... 10-2006-0094532

(51) Int. Cl.
*A45D 33/02* (2006.01)

(52) U.S. Cl. ..... 132/299

(58) Field of Classification Search ..... 132/298, 132/299, 303, 318, 320; 401/117, 272, 273, 401/286

See application file for complete search history.

(56) References Cited

U.S. PATENT DOCUMENTS 6,363,948 B2 * 4/2002 Choi ..... 132/313
6,508,256 B2 * 1/2003 Byun ..... 132/313

* cited by examiner

*Primary Examiner*—Robyn Doan
*Assistant Examiner*—Rachel R Steitz
(74) *Attorney, Agent, or Firm*—Birch, Stewart, Kolasch & Birch, LLP

(57) ABSTRACT

A make up case for discharging a powder includes an upper body including a cap insert member; a support jaw ring; an upper inside thread member; and a lower inside thread member, a lower body including a perpendicular rod body having a support member and a perpendicular rod wherein the perpendicular rod includes a closing jaw ring and a moving guide groove and the support member includes a plurality of through-holes therein; a reservoir; and an outside thread member, a middle member including an inner hole; an insert coupler; a support plate; and a cone resilient member, a discharge guide including a brush cover; a discharge hole; and a brush, and a cap, wherein the cone resilient member is pressed to open the inner hole in the state where the brush cover touches and pushes the support plate.

4 Claims, 12 Drawing Sheets

MAKE UP CASE EASY TO DISCHARGE POWDER

CROSS-REFERENCE TO RELATED APPLICATIONS

This application claims the benefit of Korean Patent Application No. 10-2006-0021157 and 10-2006-0094532, filed on Mar. 7, 2006 and Sep. 28, 2006, respectively in the Korean Intellectual Property Office, the disclosures of which are incorporated herein by reference.

BACKGROUND OF THE INVENTION

1. Field of the Invention

This present invention relates to a make up case easy to discharge powder cosmetics, and more particularly, to a make up case easy to discharge powder cosmetics which comprises; pushing a brush cover which formed on peripheral portion of a discharge guide, the discharge guide moves and press a cone type resilient member, the discharge guide moves and press a cone type resilient member, the inside hole which formed the inside middle portion, is opened by a closing jaw ring, then, the powder is discharge from through the discharge hole of the discharge guide, then, from, the release of pressing of the brush cover, the support plate, of which coupled with the discharge guide, is elevate up by the expansion power of the cone type resilient member, the inside hole is shut by the closing jaw ring, thus, the powder can not discharge the cone type resilient member is press and/or expansion, and can freely or semi-automatically control the discharge and intercept of the powder the upper body and the lower body are easy to coupling and separation, and, can be separated and refilled with powder when powder is exhausted.

2. Discussion of Related Art

Various cosmetics make up or beauty care cases have been used to satisfy demands that they should be compact and convenient for use, have an attractive appearance, and be such as to allow the cosmetics contained therein to be easily handled.

Typically, cosmetics are solid and powder or liquid state. Currently, liquid cosmetics of foundation or lipsticks are applied to the convenience of the user. The liquid cosmetics are filled in a pencil type circular container, the cosmetics are ejecting to the upper portion of brush part of the inside of the case by pressing inside of case when turns a part of the container by the user.

Conventionally, the cosmetics are solid or mixed liquid state, currently, convenience to the user lipsticks or foundation is supplied with liquid state, typically, a cosmetics liquids filled in a container of pencil type configuration, in use, a part of the container is turned to a direction, the cosmetics in the container is discharged to the portion of brush in the upper portion, and make a beauty care, in use. And there many design of construction is offered.

A Make up brush in conventional prior art, are made a brush and body in integrally. When, in use of a beauty care, a separate powder is covered on the brush. Thus, the powder and brush is separated to store, carry and provided in use, so, as to inconvenience to use.

Hereinafter, a conventional make up case will be described in detail with reference to the drawings.

While, currently, a make up brush comprises a powder is received on the inside of a container shaped body, discharge the powder to a direction of brush by air pressure; was disclosed in Korean Utility Model No. 0253672 as shown In FIGS. 11 and 12.

A first body 102, which has a form of tube with opened top and opened bottom, is filled with the cosmetics powder 103 inside thereof; a discharge hole 107 is formed on the upper middle portion of a second body 106 having a brush 108 of which connected with the discharge hole 107 on the front end, is coupled on the lower side peripherals surface of the first body 102, a spring 110 is jointed on the peripherals of the front end and the front end is coupled on the discharge hole 107 of the second body 106, the spring 110 is supported on upper end of the discharge hole 107 and provided with the up and down transfer axle 109; an upper cap 113 which support with protruding to outside upper with top of with the up and down transfer axle 109, and coupled on the top of the first body 102.

With a construction as above described, when a user get to make up with use cosmetics make up brush 100; pushing the button 102 of which protrudes to the upper side with jointed in upper end of the up and down transfer axle 109, the transfer axle 109 moves to the up and down direction, by a spring 110 which mounted on the front end of the up and down transfer axle 109, accordingly, the make up powder 103 which received in the body 102 is applied to the brush 108 through the discharge hole 107 and use in convenience.

In this moment, the make up powder 103 is applied to the brush 108 side directly, the front head of the up and down transfer axle 109 sliding through the discharge hole 107.

But, the conventional make up brush as above described, the powder 103 can not discharge evenly, structurally before the construction of the up and down transfer axle 109 and by the make up brush 100 swings it self, the use of powder 103 which is discharged to brush 108 is inconvenience. Also, the button 112 formed on the side of upper cap 113, is a stalked construction by the spring power of the spring 110 thus, in the case of carrying and custody, be hit by another articles or powered in outside, the button 112 moved and discharge the powder 103 to the brush in unnecessarily, thus, other disadvantages of damages to other articles of surrounds and non use for long time or stored humidly, rested or remained powder 103 in a body 192 or the discharge hole 103 is settled to a solid mass, and smooth discharge of powder is difficult.

However, since the conventional cosmetics make up case is composed of independent parts that are connected to each other, the number of parts that constitute the make up case is large so that manufacturing expenses increase. In particular, when the independent parts are connected to each other, it is difficult to keep the parts tightly sealed up so that it is difficult to reduce a defective proportion to no more than a predetermined level.

Also, since the number of parts that constitute the make up case is so large that assembling and manufacturing processes are complicated and that the parts assembled in minimum package units are assembled in package units of no less than four parts to be supplied to a company before filling cosmetics liquid, the number of parts to be assembled after filling the cosmetics liquid is large so that assembling processes are complicated.

SUMMARY OF THE INVENTION

In order to solve the above-described problems, it is an object of the present invention to provide a make up case capable of refilling powder in which, in pursue to the pressing and release of the brush cover formed on the peripherals of the discharge guide, a cone shaped resilient member is compressing and expanding. The inside hole formed on inside middle portion of the middle member, is open and shut down by the compressing and expanding of the closing jaw ring which formed on upper portion of the perpendicular rod. The discharge and intercept of the powder is freely control by the cone shaped resilient member. Since the upper body and the lower body are easy to coupling and release open, can be separated and refilled with cosmetics powder when cosmetics powder is exhausted, the cosmetics case is economical and convenient.

Also, it is another object of the present invention to provide a make up case capable of easy refilling cosmetics powder and of easily assembling a container by reducing the package units of the cosmetics brush to be supplied to a company.

BRIEF DESCRIPTION OF THE DRAWINGS

These and/or other objects and advantages of the invention will become apparent and more readily appreciated from the following description of preferred embodiments, taken in conjunction with the accompanying drawings of which.

DETAILED DESCRIPTION OF PREFERRED EMBODIMENTS

Hereinafter, preferred embodiments of the present invention will be described with reference to the accompanying drawings.

Figure 1:
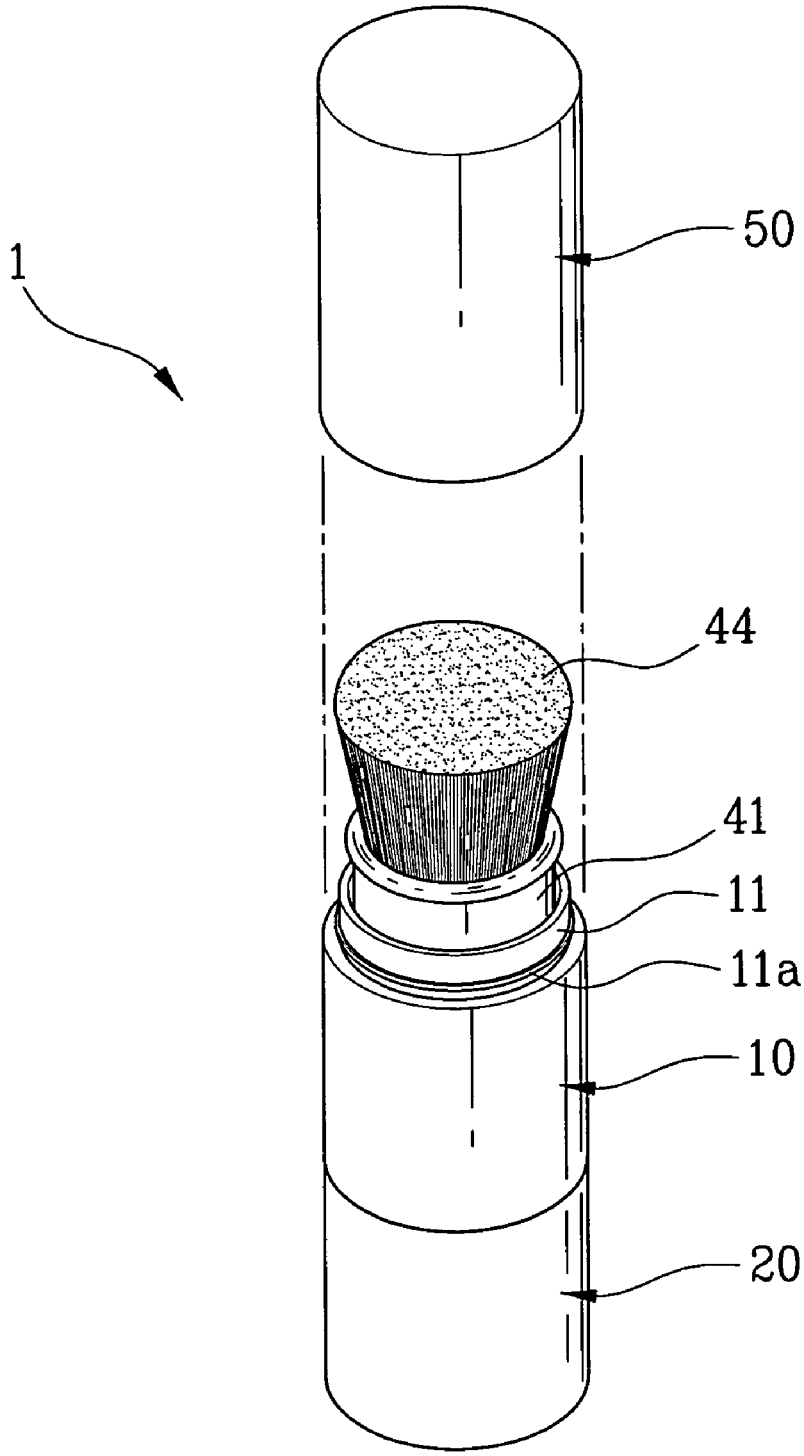
FIG. 1 is a perspective view of opened tap of a first embodiment according to the present invention.
Figure 2:
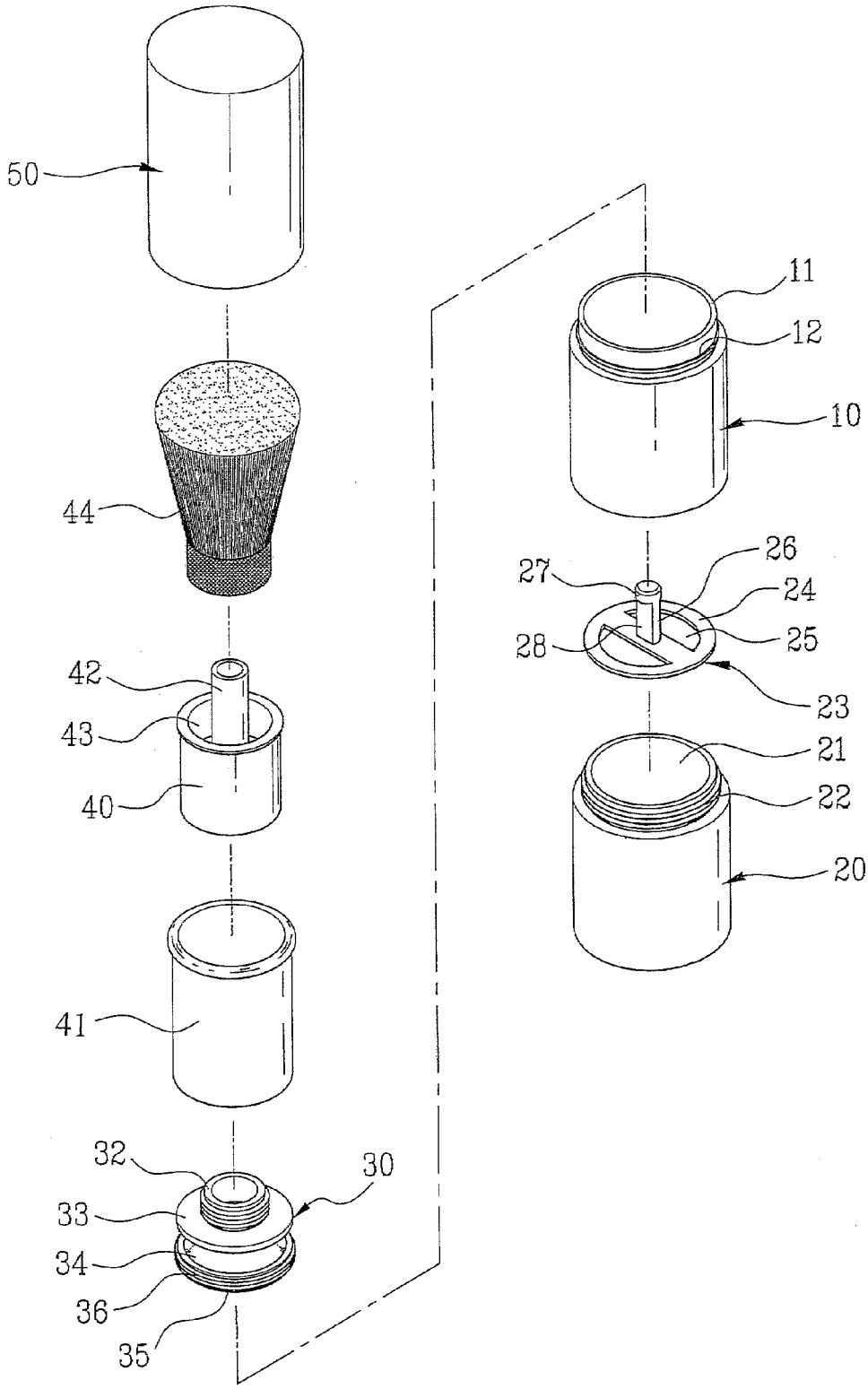
FIG. 2 is separated perspective view of a first embodiment according to the present invention.
Figure 3:
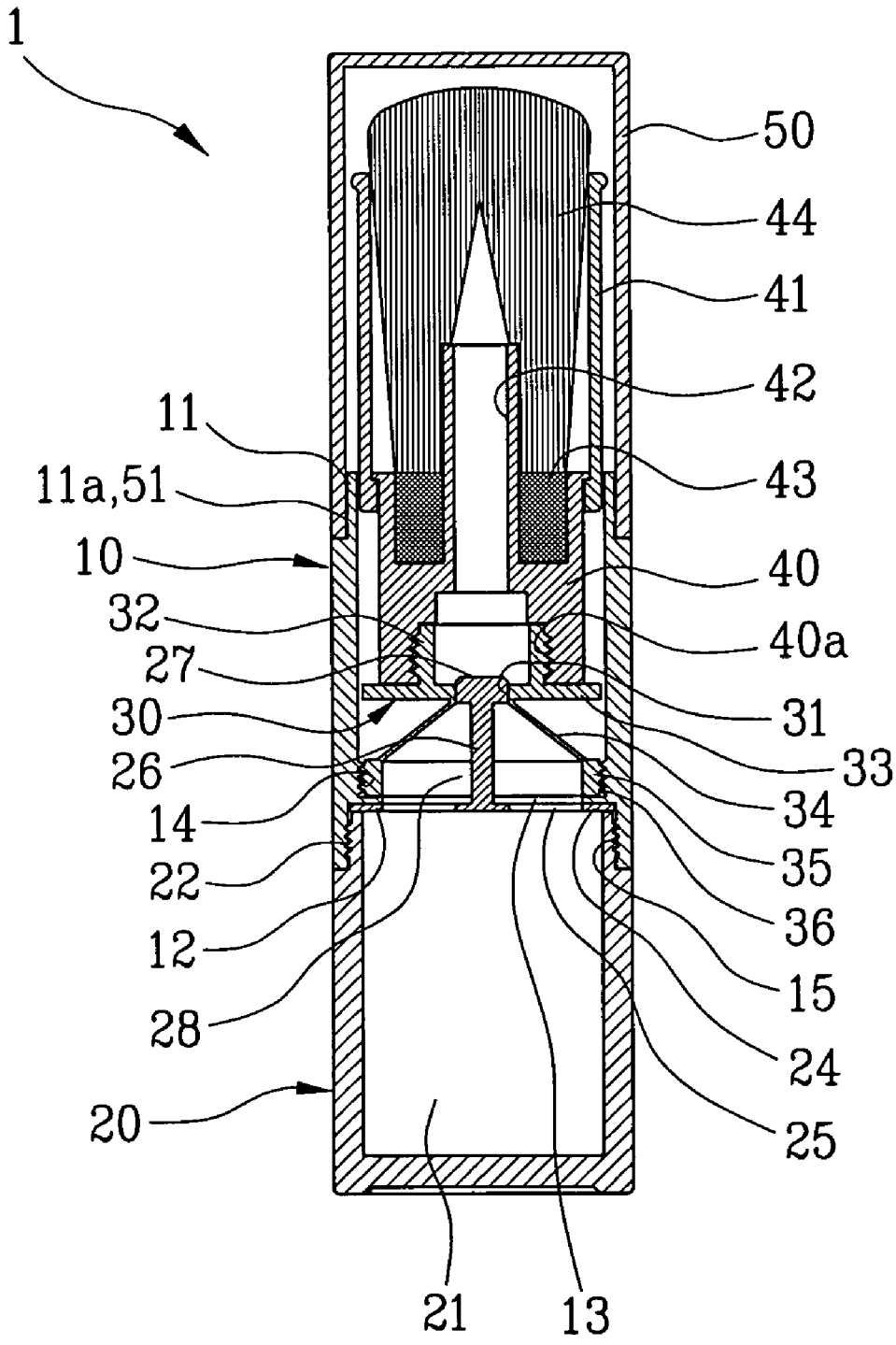
FIG. 3 is a coupling sectional drawing of a first embodiment according to the present invention.
Figure 6:
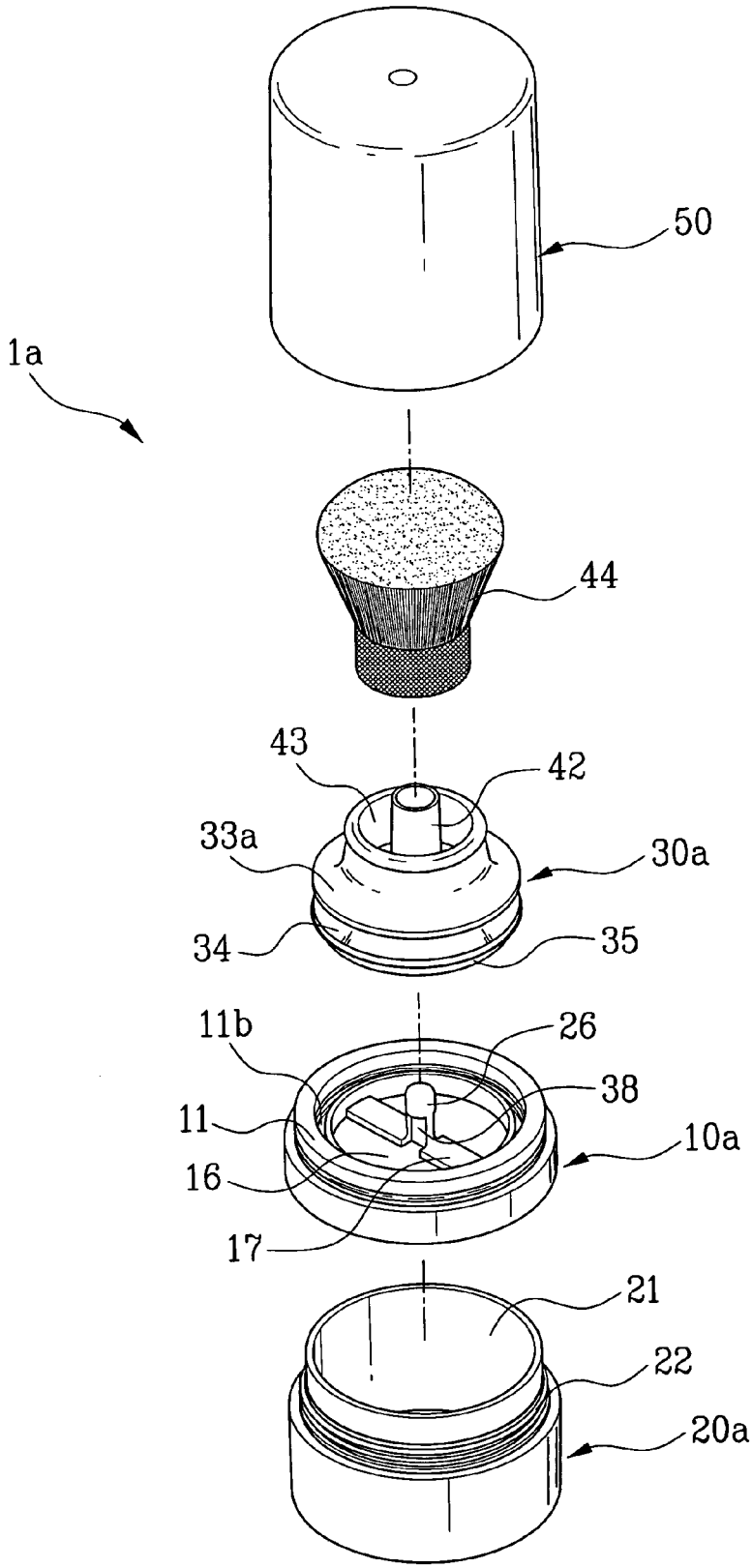
FIG. 6 is a separated perspective view of a second embodiment according to the present invention.
Figure 7:
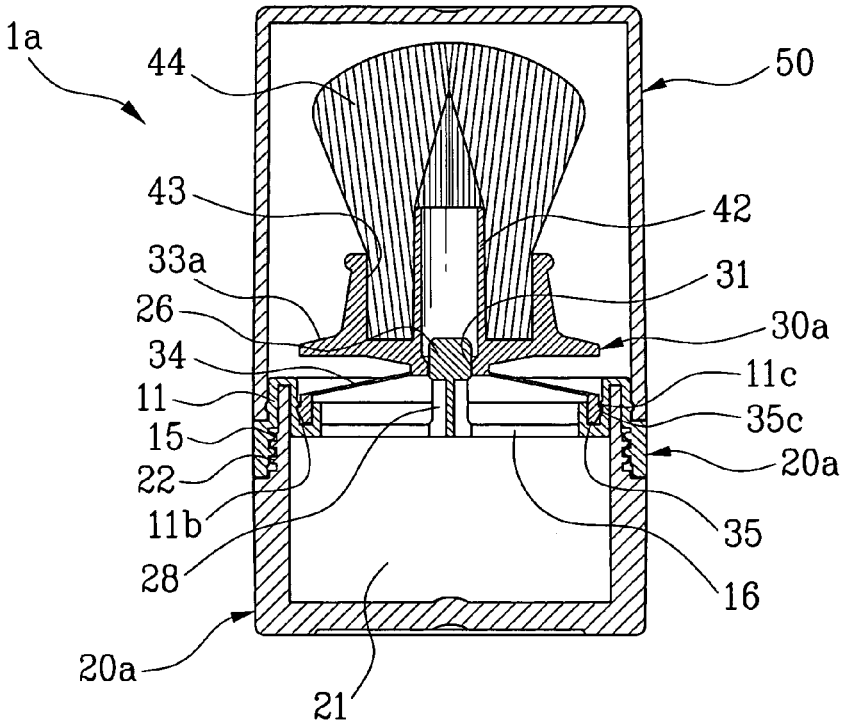
FIG. 7 is a coupling sectional drawing of a second embodiment according to the present invention.
Figure 8:
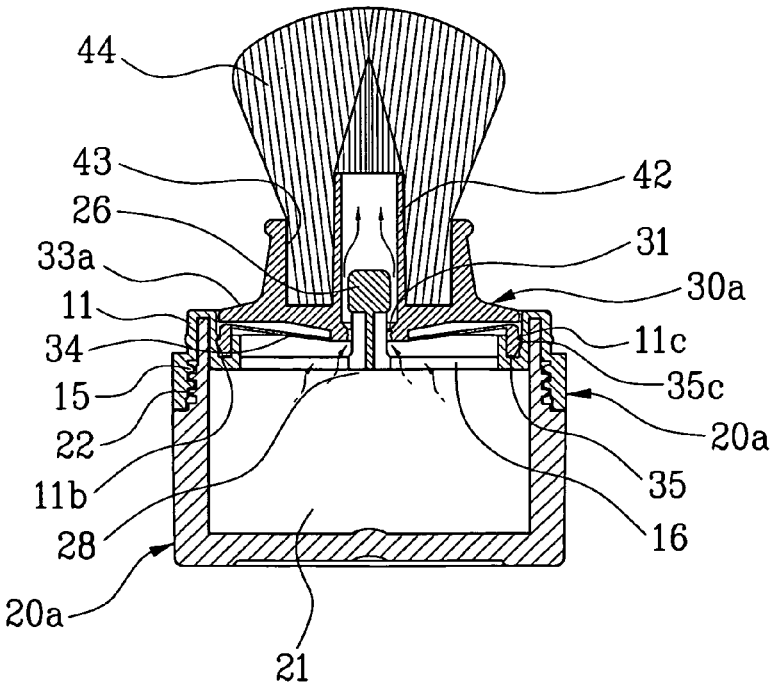
FIG. 8 is a sectional drawing of pressing middle member of a second embodiment according to the present invention.

FIG. 1 is a perspective view of opened tap of a first embodiment according to the present invention, FIG. 2 is separated perspective view of a first embodiment according to the present invention, and FIG. 3 is a coupling sectional drawing of a first embodiment according to the present invention;

FIG. 6 is a separated perspective view of a second embodiment according to the present invention, FIG. 8 is a sectional drawing of pressing middle member of a second embodiment according to the present invention, and a cosmetics case is composing to upper moving body 10, bottom moving body 20, middle member 30*m* and cap 50.

A upper moving body 10*a* that a tap inserting part 11 is formed in upper part, a coupling fitting member inserting part 11*b* is formed inside, a penetration hole 16 is formed in a center, a vertical rod 26 that is including a vertical settled moving groove 28 is formed by a supporting part 17, and an inner thread 15 is formed in bottom inner circumference; A bottom moving body 20*a* is formed to an outer thread that is thread coupled with an inner thread formed in bottom inside of the upper moving body 10*a* and is having a receiving part 21; A middle member 30*a* that a brush inserting 43 which is inserted a brush 44 by including a discharger 42 in upper part from including a inner hole 31 that is inserted into a vertical rod 26 of a upper moving body 10 is formed and is coupled by a coupling member 35 from composing to a cone type elastic part 34 to a bottom part by forming a pressing board as circumference part; and a cap is coupled with a cap 50 inserting part 11 that is formed in upper part of an upper moving body 10*a*.

An inner stumbling projection gearing 11*c* is formed as a coupling fitting member inserting part 11*b* that is formed inside of an upper moving body 10*a* and an outer stumbling projection gearing 35*c* is formed as a circumference part of a coupling member 35. Therefore, an outer stumbling projection gearing 35*c* of a coupling member 35 blocks an inner stumbling projection gearing 11*c* of a coupling fitting member inserting part 11*b* when it inserting coupled.

Also, a vertical rod 26 that is placed and inserted into an inner hole 31 of the middle member 30*a* is formed a moving groove 28 in a circumference and becomes a path to move powder.

The first embodiment pressed a pressing board 33*a* that is formed in a middle member 30*a* when it is using, a cone type elastic part 34 pressed and declined and through an upper part of a vertical rod 26 which is closed an inner hole 31 that is formed in inner center part of middle member 30*a* projected and opened the inner hole 31, a powder discharges to a brush 44 through a discharger 42 from a moving groove 28, a pressing board 33*a* rises by expansion of a cone type elastic part 34 by releasing a push of a pressing board 33*a*, a powder is not discharge by closing inner hole 31 by upper part of a vertical rod 26 and a discharge and interception of a powder can be control freely by expansion and pressing of a cone type elastic part 34 formed in a middle member 30*a*.

Figure 9:
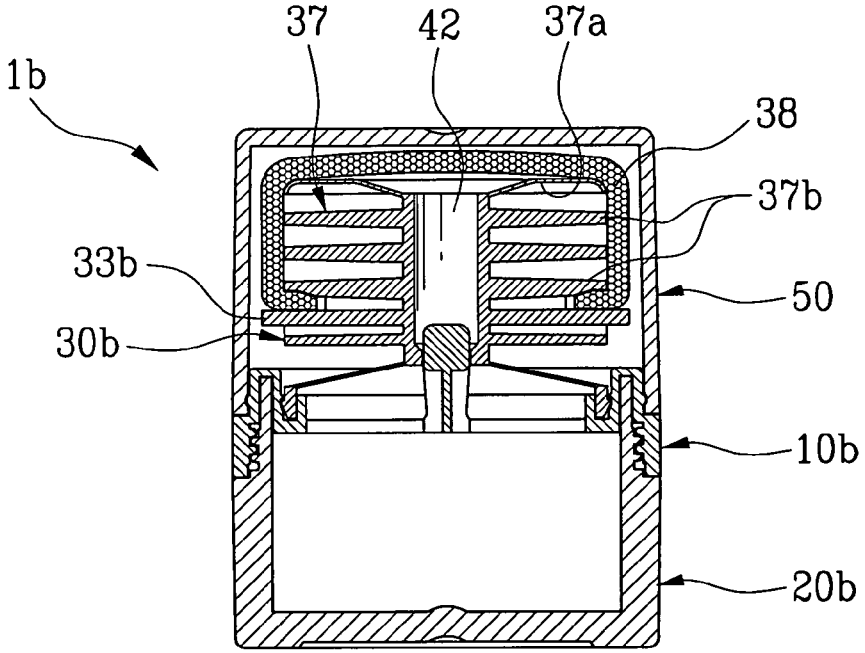
FIG. 9 is a coupling sectional drawing of a third embodiment according to the present invention.
Figure 10:
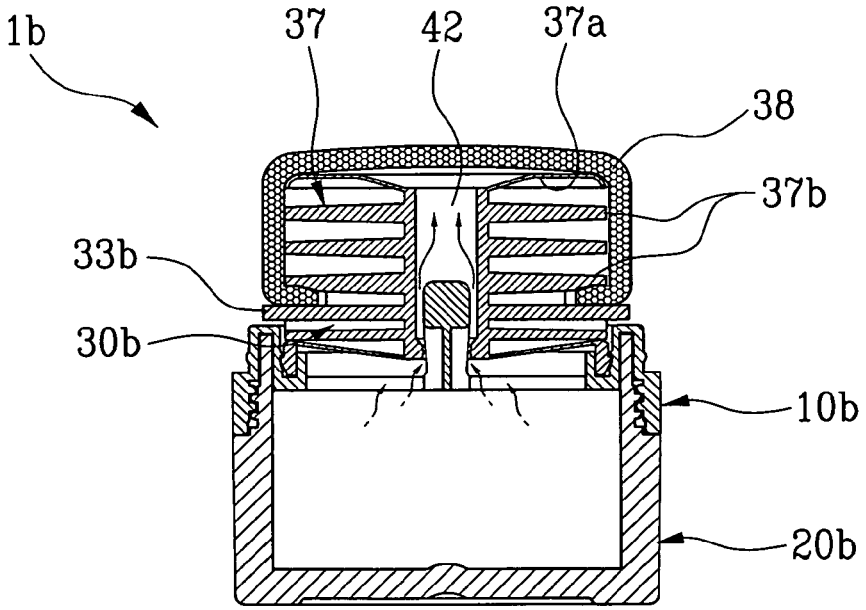
FIG. 10 is a sectional drawing of pressing middle member of a third embodiment according to the present invention.

FIG. 9 and FIG. 10 are a third embodiment according to the present invention and a cosmetics case is composing to an upper moving body 10, a bottom moving body 20, a middle member 30, and a cap 50.

A middle member 30*b* is composed to that an inner hole 31 which is inserted a vertical rod 26 of an upper moving body 10*b* is including, a pushing board which is including a cap holder part 37 that is covered with a sponge type cap 38 in upper part is formed and a coupling member 35 that is connecting with a cone type elastic part 34 in bottom part.

The second embodiment pressed a bottom moving body 20*b* in case of reaching a sponge type cap 38 that is formed in upper part of a middle member 30*b* to a skin of user (For example, face) and opened a cap 50 when it is using so that a cone type elastic part 34 pressed, an upper part of a vertical rod 26 that is closed an inner hole 31 formed inside center part of middle member 30*b* projected, and the inner hole 31 is opened so that a powder discharges to center part of a sponge type cap 38 through a discharger 42 from a moving groove 28 and it can possible to make up.

On the other hand, a cap holder part 37 that is formed in upper part of the middle member 30*c* by covering a sponge type cap 38 is formed to various holder plates 37*a*, 37*b* which are formed to various layers, a holder plate 37*a* that reached to inner bottom side of a sponge type cap 38 is formed to thin plate that is flexible to bending and recover so that a powder that is discharged to a sponge type cap 38 can be spread out and prevents to mass in one point. It can help make up softly with reducing impact to a skin by a holder plate 37*a* that is flexible to bending and recovering when a sponge type cap 38 touched and pressed to skin of user.

Through releasing pressure from a bottom moving body 20*b* after finishing make up to discharge a powder by pressing and releasing of bottom moving body 20*b*, a middle member 30*b* rises by expansion of a cone type elastic part 34, an inner hole closes and a powder will not discharge by upper part of a vertical rod 36, and discharge and interception can be control freely by pressing and expanding of a cone type elastic part 34 formed in a middle member 30*b*.

Figure 11:
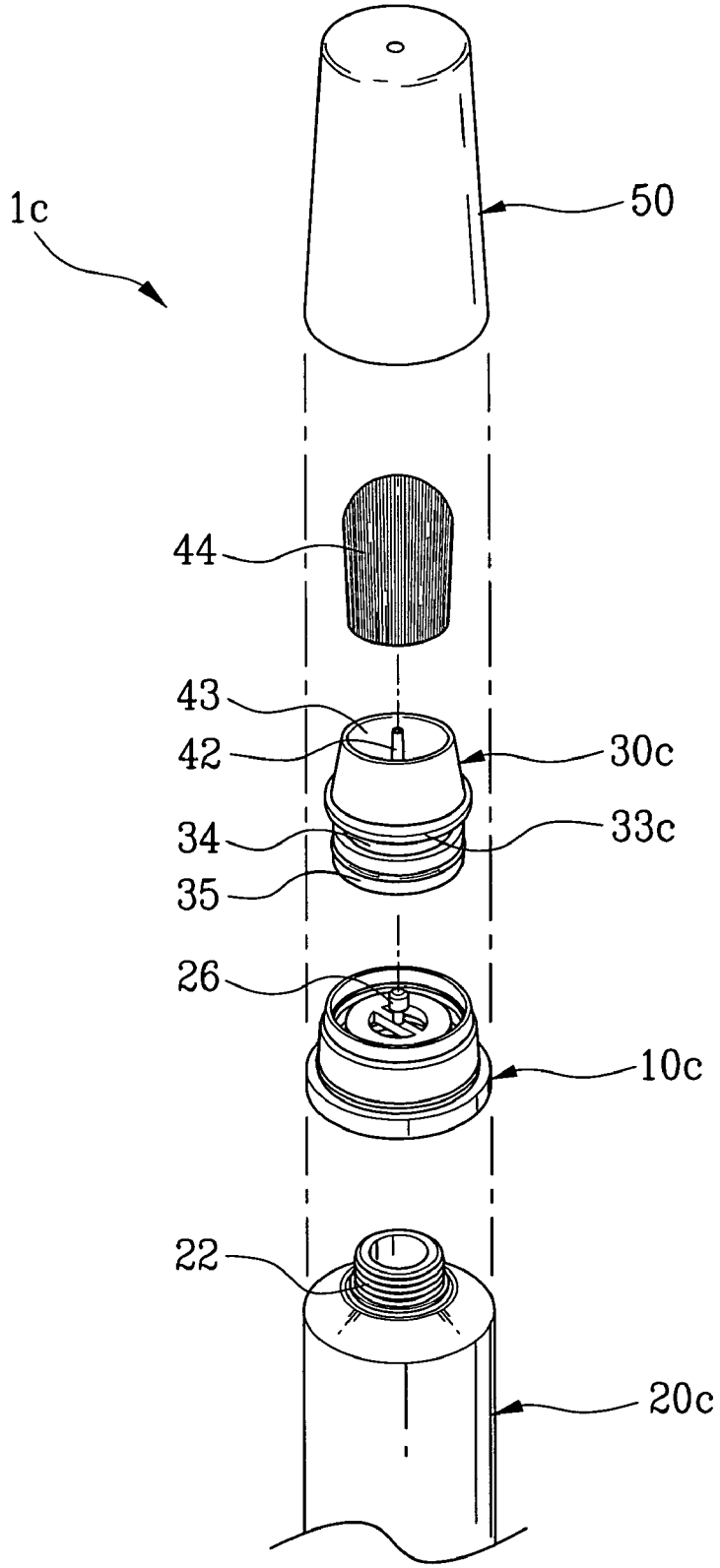
FIG. 11 is separated perspective view of a fourth embodiment according to the present invention.
Figure 12:
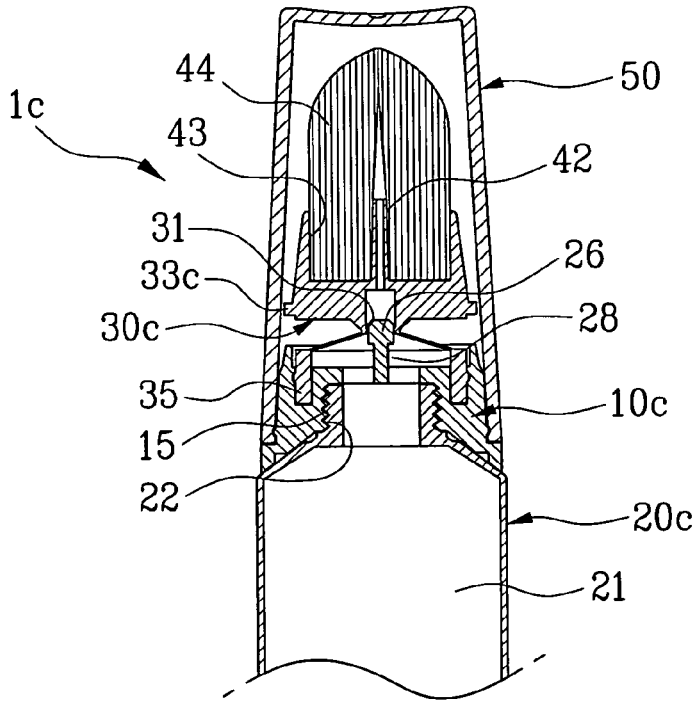
FIG. 12 is a coupling sectional drawing of a fourth embodiment according to the present invention.
Figure 13:
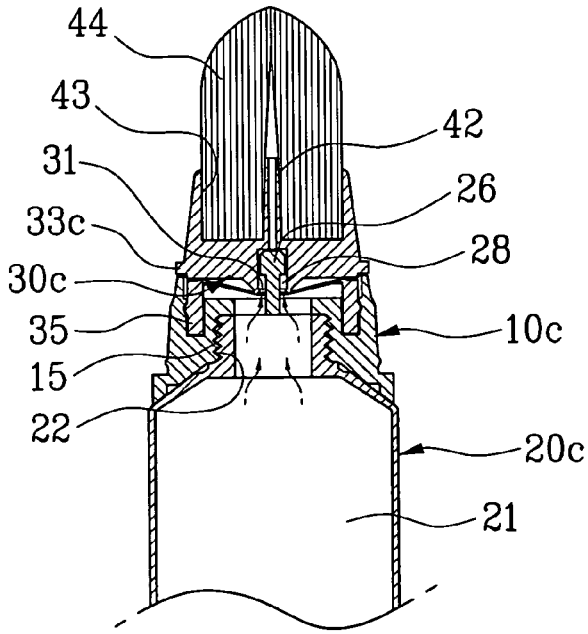
FIG. 13 is a sectional drawing of pressing middle member of a fourth embodiment according to the present invention.
Figure 14:
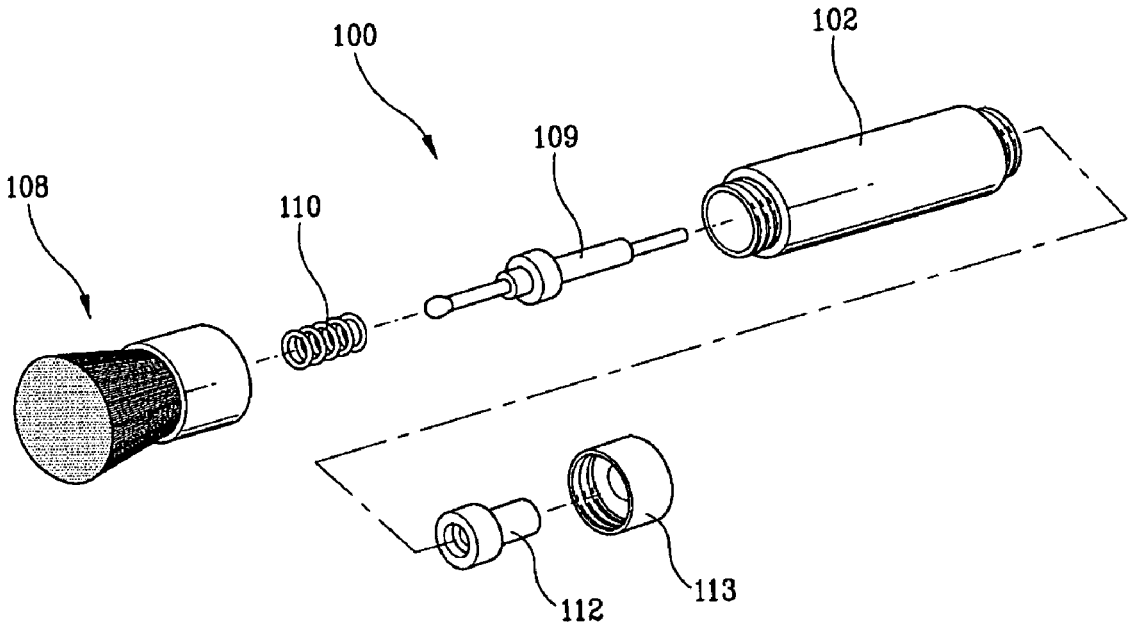
FIG. 14 is separated perspective view according to the present invention.
Figure 15:
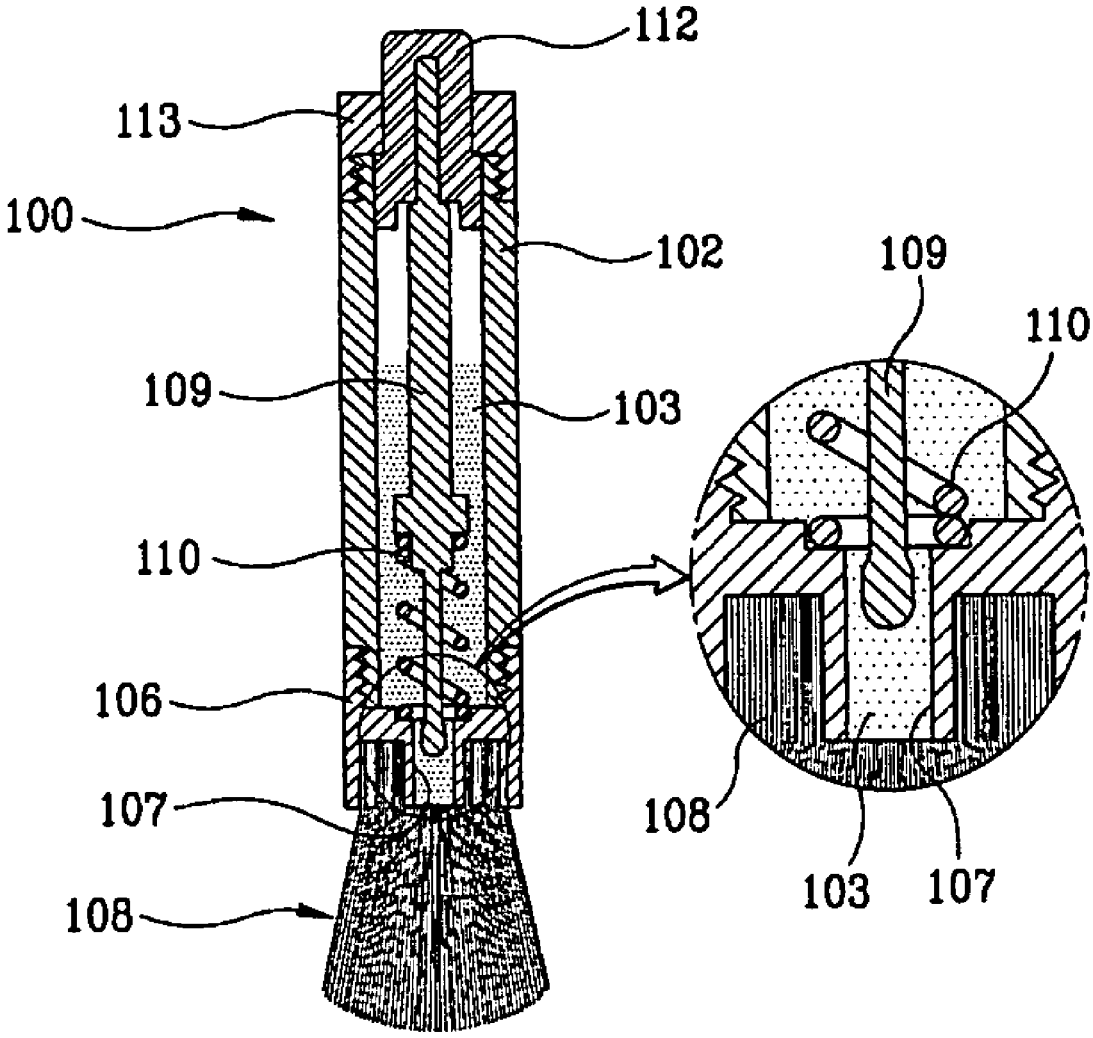
FIG. 15 is a coupling sectional drawing according to the present invention.

FIG. 11 and FIG. 12 are a third embodiment according to the present invention and a cosmetics case is composed to an upper moving body 10, a bottom moving body 20, a middle member 30, and a cap 50; the middle member 30*c* is formed an inner thread 15 inside bottom part but encounters to the inner thread 15 so that a tube type bottom moving body 20*c* that is formed an outer thread 22 is thread coupled.

A third embodiment that is thread coupled with composed tube type bottom moving body 20*c* uses by including a liquid cosmetics, both side circumference of a pressing board 33*c* formed in a middle member 30*c* pressed when it is using, a pressing board 33*c* is pressed, a cone type elastic part 34 compressed and declined, an upper part of a vertical rod 26 that is closing an inner hole 31 which is formed in a inner center part of a middle member 30 projected and the inner hole 31 opened so that a liquid cosmetics discharges to a brush 44 through a discharger 42 from a moving groove 28, a pressing board 33*c* rises by expansion of a cone type elastic part 34 by releasing pressing of a pressing board 33*c*, an inner hole 31 is closed by upper part of a vertical rod 26, a liquid cosmetics will not discharge, and discharge and interception can be control freely by compressing and expanding of a cone type elastic part 34 formed in the middle member 30*c*.

A make up case easy to discharge of powder, and more particularly, to a make up case easy to discharge of powder in which comprises an upper body 10, lower body 20 and a cap 50 are coupled; a brush cover 41 is formed on the peripheral of a discharge guide 40; when, pushing the brush cover 41, the discharge guide 40 moves and press a cone type resilient member 34, the inside hole 31 which formed the inside middle portion, is opened by a closing jaw ring 27, then, the powder is discharge from through the discharge hole 42 of the discharge guide 40, then, from, the release of pressing of the brush cover 41.

The support plate 33, of which coupled with the discharge guide 40, is elevate up by the expansion power of the cone type resilient member 34, the inside hole 31 is clogged by the closing jaw ring 27. Thus, the powder can not discharge. The cone type resilient member 34 is press and/or expansion, and can freely or semi-automatically control the discharge and intercept of the powder.

Since the upper body and the lower body are easy to coupling and release open, can be separated and refilled with cosmetics powder when cosmetics powder is exhausted, the cosmetics case is economical and convenient.

A cap insert member 11 is formed on the upper portion, a support jaw ring 12 having an through opening 13, formed on the inside, and an upper body 10 formed an upper inside thread member 14 and a lower inside thread member 15 on the support jaw ring 12 is provided a support member 24 is formed the through hole 25 on lower inside of the upper body 10, a perpendicular rod body 23 formed a perpendicular rod 26 of which having a closing jaw ring 27 and a moving guide groove 28 are formed on the lower inside of the upper body 10, the lower body 20 having a reservoir 21, is thread coupled with the lower portion inner thread member 15.

An inside hole 31 is inserted with the perpendicular rod 26 on the upper portion inside of the upper body 10 and, The inside hole 31 is provided with the perpendicular rod 26 of which inserted on the inside of the upper body 10 and an insert coupler 32 is formed on the top thereof, and a support plate 33 is formed on the peripherals thereof, and connected to the cone type resilient member 34 on the bottom thereof; and thread coupled with the middle member 30 by a coupler 35, and thread coupled with insertion coupler 32 which formed the middle member 30, a brush cover 41 is insert jointed on the outside peripherals thereof, the discharge hole 42 is provided on top of the inside middle portion, the discharge guide 40 formed, with the brush 44 of which is insert coupled on the brush insert member 43 formed on the peripherals a cap 50 is coupled on the cap insert member 11 of which formed on the top of the upper body 10.

As constructed as the above described cosmetics case 1 for discharge powder is acting;

When, pushing the brush cover 41 which formed on the peripherals of the discharge guide 40, the discharge guide 40 is descend, and pressing the cone type resilient body 34 so as to, the perpendicular rod 26 which clogged the inside hole 31 formed on inside middle portion of the middle member 30, is release to protrudes thus, the inside hole is opened so as to the powder is discharge and pass through the discharge hole 42 of the discharge guide 40 to the brush 44.

Then, as to the release on the pressing on the brush cover 41, the support plate 33 elevate up, then, the inside hole 31 is clogged by the cone type resilient member 34 which formed on top of the perpendicular rod 26 and not discharge the powder more.

Thus, the powder discharge and close is freely control with a semi-automatically as the followings, further described referred to the attached drawings In FIG. 1-FIG. 3, the lower body 20 is thread coupled on the bottom of the upper body 10, to the upper portion, the brush cover 41 insert jointed to the discharge guide 40 with coupled to the middle member 30 in which is thread coupled on the upper inside of the upper body 10, and the cap 50 covered and jointed on.

To the above joint constructed upper body 10, the cover insert 11 which formed a jointing ring 11*a* on the peripherals of the upper portion of the upper body 10. the support jaw ring 12 formed the through hole 13 in the middle of the inside; upper inside thread member 14 and lower inside thread member 15 are formed on the top and bottom of the support jaw ring 12 the lower body 20, which formed the reservoir 21 and outside thread member 22, on the lower portion of the upper body 10, and is thread coupled with lower inside thread member 15 which formed on the bottom of the upper body 10.

The perpendicular rod body 23 is coupled in between the bottom of the upper body 10 and top of the lower body 20, the perpendicular rod body 23 in which formed the support member 24 of which the through hole 25 on the lower portion of the perpendicular rod body 23 positioned on the top of the outside thread member 22 of the lower body 20, and insert pressing with the support jaw ring 12 of which formed on the inside of the upper body 10 and, the perpendicular rod 26 of which mounted with the closing jaw ring 27 and the moving guide groove 28, is perpendicular installed on the middle portion.

The middle member 30 of which coupled the discharge guide 40, is thread coupled on the inside upper portion of the upper body 10, the perpendicular rod 26 is insert to the inside hole 31 with middle inside of the middle member 30 is provided.

The insert coupler 32 of which thread coupled with the guide hole inside nut member 40*a* which formed on the bottom inside of the discharge guide hole 40, are provided on the top, and the support plate 33 is formed on the peripherals thereof. The cone type resilient member 34 is connected on the lower portion of the inside hole 31. The coupler 35 with the outside coupling thread member 36 is formed and thread coupled with the upper inside thread member 14 which formed on upper inside of the upper body 10.

The discharge guide 40 of which thread jointed on the upper portion of the middle member 30, is insert jointed with the brush cover 41 on peripherals thereof, the brush cover 41 is insert jointed on the peripherals outside, and the discharge hole 42 is mounted on inside middle top, and the brush insert member 43 which the brush 44 is insert fitted on the peripherals thereof. While, the brush cover 41 inserted on the peripherals of the discharge guide 40 on the bottom thereof.

On the lower portion of the discharge guide 40, inserted to the peripherals of the discharge guide 40, then, by the insert coupler 32 formed on the upper portion of the middle member 30 to a guide hole inside thread member 40*a* which formed on the lower part of the discharge guide 40;

The lower end of brush cover 41 is supported and not intercept by the support plate 33, of which formed the middle member 30 and, slides to up and down movement on outside of the discharge guide 40 and thus, gathering the brush.

Therefore, the discharge guide 40, which provided with the brush 44, is coupled on the upper portion of the upper body 10, and the inside protrudes ring 51 which formed on inside lower portion of the cap 50, is suspend coupled to the suspending protrudes ring 11*a* of the cap insertion member 11, of which formed to the top of the upper body 10.

Figure 4:
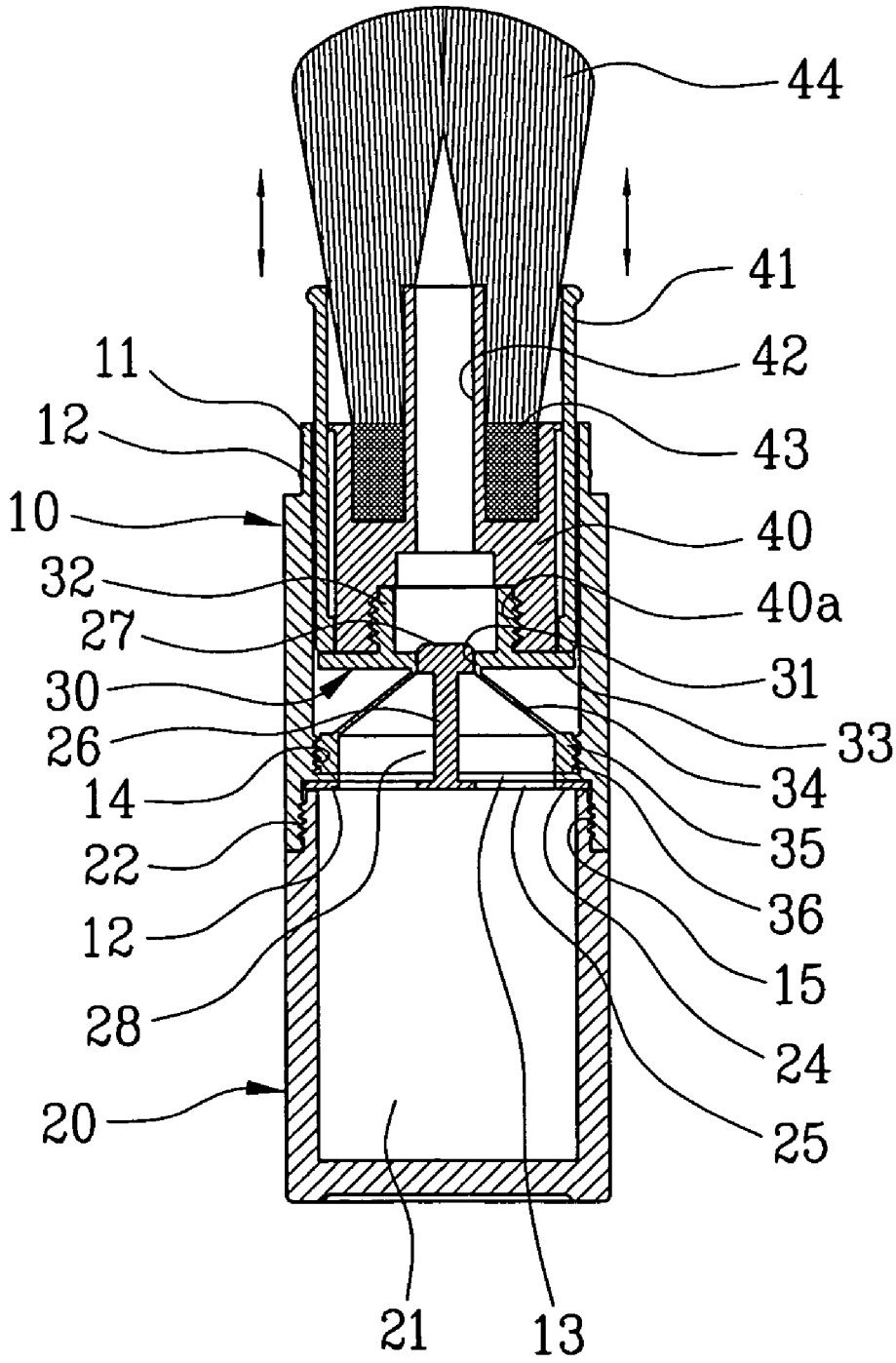
FIG. 4 is a sectional drawing of sliding moving a brush cover to a bottom moving body of a first embodiment according to the present invention.

The above described as constructed as above, now, the effect and acting according to the present invention, is as follows;

FIG. 3 and FIG. 4 shows, before use of the make up case 1;

FIG. 3 shows, the state in coupled cap 50, FIG. 4 shows, after replaced the cap 50, the brush cover 41 is sliding moved to the lower body side. The lower portion of the brush cover 41 is coupled with the bottom of the discharge guide 40, and touch on the support plate 33 formed on middle member 30; the brush cover 41 is sliding moves on the peripherals of the discharge guide 40. The closing jaw ring 27 is formed on the top of the perpendicular rod 26 of the perpendicular rod body 23. At this moment, the closing jaw ring 27 is positioned on the inside hole 31 which formed on middle inside of the middle member 30 and closed.

Figure 5:
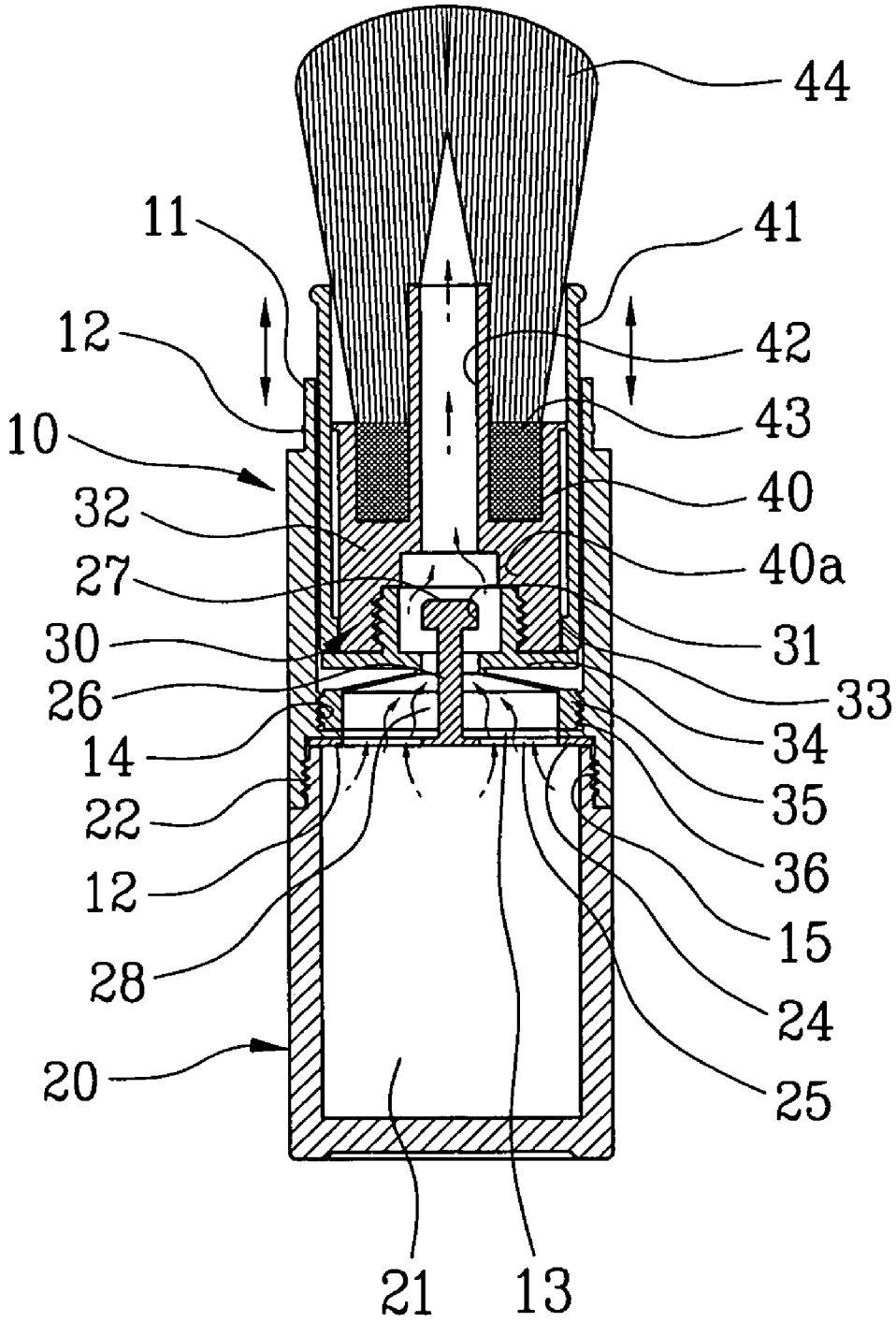
FIG. 5 is a sectional drawing of pressing a brush cover of a first embodiment according to the present invention.

As above, in the state of lower portion of the brush cover 41 is touched on the support plate 33, a make up case 1 according to the present invention, as shows in FIG. 5 the brush cover is push pressed to the side of lower body 20; the brush cover 41 moves to push the support plate 33, the cone resilient member 34 is pressed, which formed on the bottom of the support plate 33.

A closing jaw ring 27 which clogged the inside hole 31 formed on upper end of the perpendicular rod 26, is removed from the inside hole 31 and protrudes to upper portion and opened concurrently with pushing press the inside reservoir 21 of the lower body 20. the cone resilient member 34 is pressed, in the state of opened inside hole 31, the powder in the reservoir 21 of the lower body 20 discharge through the through opening 13 of the upper body 10, a through hole 25 of the perpendicular rod body 23, by the pressure of pressing, inside hole 31 of the middle member 30 and discharge opening 42 of the powder opening to the side of the brush 44.

While, the inside hole 31 is opened by pressing of the brush cover 41, pursuant to release of the pressing power, the cone resilient member 34 is expanding to return to the state of before the pressing, thus, the closing jaw ring 27 of the perpendicular rod 26 clogged the inside hole 31 which formed on middle portion of the middle member 30; and, prevent the flue of the powder in non use.

Therefore, by repeated push and release of the brush cover 41, the con type resilient member 34 is expansion and compressing while, the inside hole 31 is open and close by the closing jaw ring 27 of the perpendicular rod 26 which formed the perpendicular rod body 23.

For the beauty care, if, push the brush cover 41, the inside hole 31 is opening to the easy the discharge of the powder; and release of the added power, the inside hole 31 is clogged in it self thus easy to use.

Also, the upper body 10 and lower body 20 are screw thread jointed, easy to assembly and disjoint, the powder received in the reservoir 21 is evacuated, easy to separate the lower body 20 and refill are available.

It is preferable to practical use the portion of the brush 44 is in the direction of lower portion, besides in FIG. of the present invention, the portion of the brush 44 is in the direction to the upper in convenience in figure.

FIG. 6 a exploded perspective view of the removing of the cap of the another embodiment according to the present invention;

The upper body 10*a*, lower body 20*a*, the discharge guide 40*a* and cap 50*a* is a polygon configured to the make up case la with the preferable to the user and maker and the male up case la has same action and effect as the make up case 1.

Although a few embodiments of the present invention have been shown and described, it would be appreciated by those skilled in the art that changes might be made in this embodiment without departing from the principles and spirit of the invention, the scope of which is defined in the claims and their equivalents.

What is claimed is:

1. A make up case for discharging powder comprising:

an upper body, the upper body including:

a cap insert member formed on an upper portion of the upper body;

a support jaw ring having a through-opening formed on an inside of the upper body;

an upper inside thread member on the support jaw ring; and a lower inside thread member under the support jaw ring;

a lower body, the lower body including:

a perpendicular rod body formed on an upper portion of the lower body, the perpendicular rod body having a support member on the lower portion of the perpendicular rod body and a perpendicular rod vertical to the support member, the perpendicular rod including a closing jaw ring and a moving guide groove, and the support member including a plurality of through-holes therein;

a reservoir for retaining the powder; and an outside thread member at a peripheral side of an upper portion of the lower body, the lower body being thread coupled with the upper body through the lower inside thread member;

a middle member formed on an inner side of the upper body, the middle member including:

an inner hole in the center portion of the middle member for the perpendicular rod to be inserted therein;

an insert coupler formed on a top portion of the middle member;

a support plate formed at a peripheral side of the inner hole;

a cone type resilient member on the bottom of the middle member and connected to the support plate; and a coupler having an outside coupling thread member to thread couple the middle member with the upper body;

a discharge guide inserted onto the insert coupler of the middle member, the discharge guide including:

an upwardly projecting discharge hole provided in a middle portion of the discharge guide; and a brush engaged with a brush insert member formed at a peripheral side of the discharge hole;

a brush cover inserted onto an outside of the discharge guide; and a cap being coupled with the upper body though the cap insert member of the upper body, wherein the cone type resilient member is pressed to open the inner hole in the state where the brush cover touches and pushes the support plate.

2. A make up case in accordance with claim 1, comprising:

a upper moving body that a tap inserting part is formed in upper part, a coupling fitting member inserting part is formed inside, a penetration hole is formed in a center, a vertical rod that is including a vertical settled moving groove is formed by a supporting part, and an inner thread 15 is formed in bottom inner circumference; A bottom moving body is formed to an outer thread that is thread coupled with an inner thread formed in bottom inside of the upper moving body and is having a receiving part;

a middle member that a brush inserting which is inserted a brush by including a discharger in upper part from including a inner hole that is inserted into a vertical rod of a upper moving body is formed and is coupled by a coupling member from composing to a cone type elastic part to a bottom part by forming a pressing board as circumference part; and a cap is coupled with a cap inserting part that is formed in upper part of an upper moving body.

3. A make up case in accordance with claim 2 wherein the middle member is composed to that an inner hole which is inserted a vertical rod of an upper moving body is including, a pushing board which is including a cap holder part that is covered with a sponge type cap in upper part is formed and a coupling member that is connecting with a cone type elastic part in bottom part.

4. A make up case in accordance with claim 1, wherein the middle member is formed an inner thread inside bottom part but encounters to the inner thread so that a tube type bottom moving body that is formed an outer thread is thread coupled.

* * * * *